US007529376B2

(12) United States Patent
Konagai

(10) Patent No.: US 7,529,376 B2
(45) Date of Patent: May 5, 2009

(54) DIRECTIONAL SPEAKER CONTROL SYSTEM

(75) Inventor: Yusuke Konagai, Hamamatsu (JP)

(73) Assignee: Yamaha Corporation (JP)

( * ) Notice: Subject to any disclaimer, the term of this patent is extended or adjusted under 35 U.S.C. 154(b) by 244 days.

(21) Appl. No.: 10/572,832

(22) PCT Filed: Sep. 24, 2004

(86) PCT No.: PCT/JP2004/014437

§ 371 (c)(1),
(2), (4) Date: Mar. 22, 2006

(87) PCT Pub. No.: WO2005/032207

PCT Pub. Date: Apr. 7, 2005

(65) Prior Publication Data

US 2007/0019816 A1 Jan. 25, 2007

(30) Foreign Application Priority Data

Sep. 25, 2003 (JP) ..... 2003-332984

(51) Int. Cl.
*H04R 1/40* (2006.01)

(52) U.S. Cl. ..... 381/97; 381/61; 381/300; 381/306

(58) Field of Classification Search ..... 381/59, 381/97, 300, 310, 304–306, 61, 63, 182, 381/186, 335, 184, 89, 77, 80
See application file for complete search history.

(56) References Cited

U.S. PATENT DOCUMENTS 5,109,416 A * 4/1992 Croft ..... 381/304
5,119,428 A 6/1992 Prinssen
5,201,006 A * 4/1993 Weinrich ..... 381/318

(Continued)

FOREIGN PATENT DOCUMENTS

JP H03-159500 9/1991

(Continued)

OTHER PUBLICATIONS

Relevant portion of International Search Report of corresponding PCT Application PCT/JP2004/014437.

(Continued)

*Primary Examiner*—Vivian Chin
*Assistant Examiner*—Disler Paul
(74) *Attorney, Agent, or Firm*—Rossi, Kimms & McDowell LLP

(57) ABSTRACT

In a directional speaker control system for realizing good sound localization by correcting the directivity of a directional speaker, adapted to an audio surround system in which a desired sound is reflected on a wall surface or a sound reflection board so as to produce a virtual speaker, a first directional speaker emits a first sound toward the wall surface or sound reflection board so that the reflected sound reaches a prescribed listening position, and a second directional speaker emits a second sound, which comes to have an inverse phase with respect to an audio element of the first sound reaching the listening position directly, toward the listening position. Thus, it is possible to adequately dampen the audio element (particularly, low-frequency components) emitted directly toward the listening position from the first directional speaker; hence, it is possible to realize good sound localization.

3 Claims, 11 Drawing Sheets

U.S. PATENT DOCUMENTS

| | | | | |
|---|---|---|---|---|
| 5,233,664 | A | 8/1993 | Yanagawa et al. | |
| 5,636,283 | A | 6/1997 | Hill et al. | |
| 5,809,153 | A * | 9/1998 | Aylward et al. | 381/337 |
| 5,953,432 | A * | 9/1999 | Yanagawa et al. | 381/335 |
| 6,111,962 | A | 8/2000 | Takahashi | |
| 6,141,415 | A | 10/2000 | Tandhoni | |
| 6,791,519 | B2 * | 9/2004 | Aarts et al. | 345/87 |
| 6,996,240 | B1 | 2/2006 | Atsushi | |
| 7,054,448 | B2 | 5/2006 | Hajime | |
| 7,092,541 | B1 * | 8/2006 | Eberbach | 381/300 |
| 7,362,874 | B2 * | 4/2008 | Lee et al. | 381/307 |

FOREIGN PATENT DOCUMENTS

| | | | |
|---|---|---|---|
| JP | 6-178379 | A | 6/1994 |
| JP | 2000-36993 | A | 2/2000 |

OTHER PUBLICATIONS

Related co-pending U.S. Appl. No. 10/572,831 ; Yusuke Konagai et al.; "Audio Characteristic Correction System"; filed Mar. 22, 2006 ; Spec. pp. 1-29 ; Figs. 1-13 ; Preliminary Amendment.

Office Action issued in co-pending related U.S. Appl. No. 10/572,831, mailed Oct. 3, 2007.

* cited by examiner

DIRECTIONAL SPEAKER CONTROL SYSTEM

This application is a U.S. National Phase Application of PCT International Application PCT/JP2004/014437 filed on Sep. 24, 2004.

TECHNICAL FIELD

This invention relates to directional speaker control systems in which sounds emitted from directional speakers such as array speakers are reflected on wall surfaces or sound reflection boards so as to produce virtual speakers.

BACKGROUND ART

Recently, various audio sources have been distributed and provided in the open market; and DVDs (digital versatile disks) store multi-channel audio signals of 5.1 channels, for example. Digital surround systems for reproducing audio sources have come to be widespread among general households. FIG. 14 is a plan view showing an example of a layout of speakers in a digital surround system, wherein reference numeral Zone designates a listening room for performing audio surround playback; reference numeral U designates a listening position; reference numeral SP-L designates a speaker for reproducing a main left signal L; reference numeral SP-R designates a speaker for reproducing a main right signal R; reference numeral SP-SL designates a speaker for reproducing a rear left signal SL; reference numeral SP-SR designates a speaker for reproducing a rear right signal SR; reference numeral SP-SW designates a sub-woofer for reproducing a sub-woofer signal (a low-frequency signal) LFE; and reference symbol MON designates a video device such as a television receiver.

The digital surround system of FIG. 14 can effectively produce various sound fields. Since plural speakers are separately arranged in the listening room Zone, the digital surround system has drawbacks in that in order to arrange surround rear speakers SP-SL and SP-SR in the rear of the listening position U, wiring lengths between the speakers must be increased, and the arrangement of the rear speakers SP-SL and SP-SR is limited by the shape of the listening room Zone and the arrangement of furniture.

In order to solve the aforementioned drawbacks, rear speakers are formed using directional speakers having sharp directivities and arranged in front of the listening position, while a sound reflection board is arranged in the rear of the listening position. There is provided an audio surround system in which surround-channel sounds emitted from directional speakers are reflected on sound reflection boards so as to demonstrate an effect similar to an effect realized by arranging rear speakers in the rear of the listening position. This is disclosed in Japanese Unexamined Patent Application Publication No. H06-178379, for example. FIG. 15 is a plan view showing an example of a layout of speakers in an audio surround system disclosed in this Japanese Unexamined Patent Application Publication, wherein reference numerals B-L and B-R designate sound reflection boards.

It is possible to use a method in which a wall surface positioned in the rear of a listening room is used as a sound reflection board as shown in FIG. 16. In a three-dimensional stereo audio playback method disclosed in Japanese Unexamined Application Publication No. H03-159500, for example, an array speaker is used to produce virtual sound sources in the space. By use of this technology, it is possible to produce virtual speakers in the rear of a listening position.

As described above, it is possible to produce virtual speakers in the rear of a listening position by arranging sound reflection boards in the rear of the listening position or by using a wall surface of a listening room as a sound reflection board. However, this method may be strongly affected by sound directly emitted from a directional speaker arranged in front of the listening position; hence, it has a problem in that sound localization similar to sound localization realized by arranging rear speakers in the rear of the listening position cannot be affected. This is because human ears are shaped to easily pick up sound from the front, and the Haas effect may occur because direct sound reaches the ears of the listener first since a distance for directly transmitting sound to the listener without the intervention of a wall is shorter than a distance for transmitting sound emitted from a directional speaker after reflection on a wall.

This invention is made to solve the aforementioned problems; hence, it is an object of the invention to provide a directional speaker control system adapted to an audio surround system in which sound emitted from a directional speaker is reflected on a wall surface or a sound reflection board so as to produce virtual speakers, wherein good sound localization is realized by correcting the directivity of the directional speaker.

DISCLOSURE OF THE INVENTION

This invention provides a directional speaker control system in which sound emitted from a directional speaker having sharp directivity is reflected on a wall surface or a sound reflection board so as to produce virtual speakers. It includes a first directional speaker for emitting a first sound toward the wall surface or sound reflection board, and a second directional speaker for emitting a second sound which comes to have an inverted phase at a listening position compared with the phase of an audio element of the first sound reaching the listening position directly, wherein the directivity of the first directional speaker is corrected based on the second sound.

For example, the first directional speaker such as an array speaker having high directivity is arranged at a prescribed position, and the sound thereof is emitted towards and reflected on the wall surface or the sound reflection board, which is positioned at a position different from the position of the first directional speaker, thus realizing sound localization as if a speaker existed at the position of reflection. The first sound emitted from the first directional speaker contains an audio element reaching the listening position directly; hence, there occurs a phenomenon in which a sound image to be localized at a prescribed position of the wall surface or the sound reflection board is localized in proximity to the first directional speaker. Since it is difficult to increase energy of sound reflected on the wall surface or the sound reflection board, the audio element reaching the listening position directly from the first directional speaker is dampened using the second sound emitted from the second directional speaker.

In a concrete example of the constitution of the directional speaker control system of this invention, a single array speaker device is divided into a first directional speaker and a second directional speaker as described above.

The second directional speaker emits low-frequency components of sound only as the second sound.

In this invention, an audio element of the first sound emitted from the first directional speaker and reaching the listening position directly is dampened using the second sound emitted from the second directional speaker; hence, compared with the audio element reaching the listener from the first directional speaker directly, it is possible to enhance the reflected sound, which is produced by reflecting the first sound on the wall surface or the sound reflection board and then letting it reach the listener. Thus, it is possible to realize good sound localization similar to that realized by arranging speakers in the rear of the listener. In addition, the first directional speaker and the second directional speaker can produce virtual rear speakers. This eliminates the necessity of arranging rear speakers in the rear of the listening position; hence, it is possible to reduce wiring distances between the speakers.

A single array speaker is used to realize both the first directional speaker and second directional speaker; hence, even when another array speaker is used to perform sound cancellation using inverse phases, it is possible to prevent the listener from feeling uncomfortableness in hearing.

Furthermore, the sound subjected to dampening control by the second directional speaker is limited to a low-frequency sound; hence, it is possible to effectively dampen an audio element of the first sound emitted from the first directional speaker and reaching the listening position directly; and it is possible to avoid a problem in which the audio element to be dampened at the listening position increases in level unexpectedly.

BEST MODE FOR CARRYING OUT THE INVENTION

Preferred embodiments of this invention will be described in detail by way of examples with reference to the accompanying drawings.

First Embodiment

Figure 1:
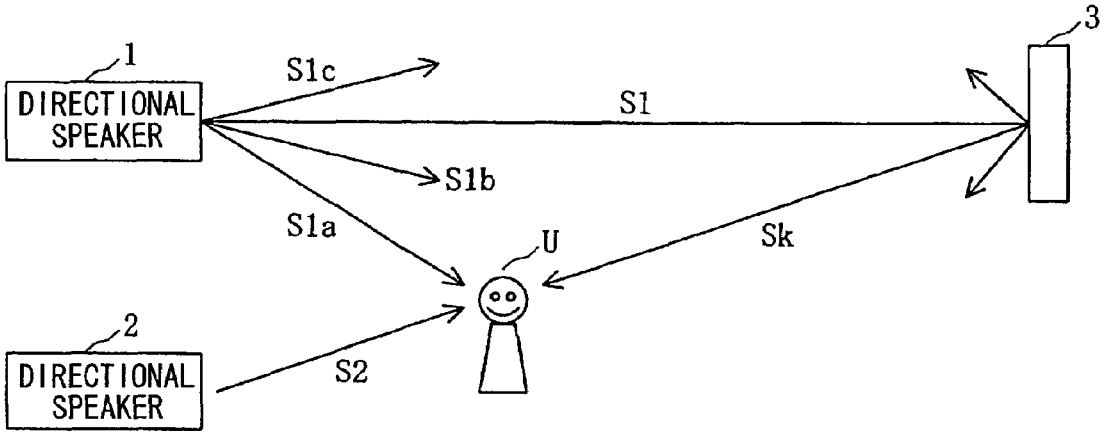
FIG. 1 is a block diagram showing the constitution of a directional speaker control system in accordance with a first embodiment of this invention.

FIG. 1 is a block diagram showing the constitution of a directional speaker control system (i.e., a surround system) in accordance with a first embodiment of this invention. FIG. 1 shows only the constitution regarding a surround channel (i.e., a rear left signal SL or a rear right signal SR), and it does not show the constitution regarding a main channel (i.e., a main left signal L or a main right signal R).

The directional speaker control system according to the first embodiment of this invention includes a first directional speaker 1 for emitting a first sound S1 towards a wall surface of a listening room or a sound reflection board 3 and a second directional speaker 2 for emitting a second sound S2 whose phase is inverse to that of an audio element S1*a* of the first sound S1 which reaches a listening position U directly.

Figure 2:
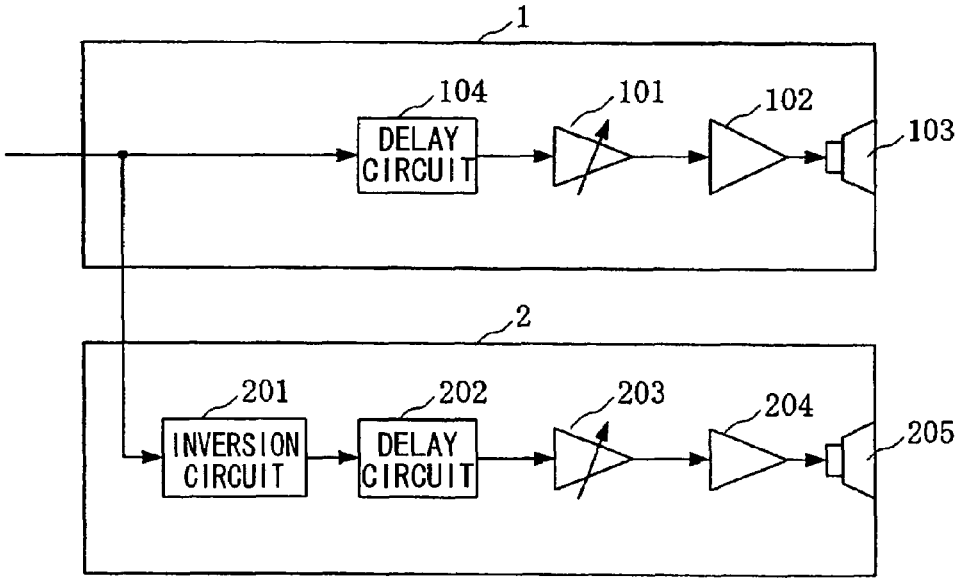
FIG. 2 is a block diagram showing internal constitutions of first and second directional speakers shown in FIG. 1.

FIG. 2 is a block diagram showing internal constitutions of the directional speakers 1 and 2. The first directional speaker 1 includes a delay circuit 104 for delaying an input surround-channel audio signal (i.e., a rear left signal SL or a rear right signal SR) by a prescribed delay time T1, a gain adjustment circuit 101 for adjusting a gain of an output signal of the delay circuit 104 to a desired level, an amplifier 102 for amplifying an output signal of the gain adjustment circuit 101, and a speaker 103 driven by the output of the amplifier 102.

The second directional speaker 2 includes an inversion circuit 201 for inverting the phase of the surround-channel audio signal, a delay circuit 202 for adjusting a delay time applied to an output signal of the inversion circuit 201 such that the audio element S1*a* of the first sound S1 reaching the listening position U from the directional speaker 1 directly is canceled out by the second sound S2 emitted from the directional speaker 2, a gain adjustment circuit 203 for adjusting a gain of an output signal of the delay circuit 202 such that the audio element S1*a* is canceled out by the second sound S2, an amplifier 204 for amplifying an output signal of the gain adjustment circuit 203, and a speaker 205 driven by the output of the amplifier 204.

Next, the operation of the directional speaker control system of the present embodiment will be described in detail.

In the directional speaker 1, the delay circuit 104 delays a surround-channel audio signal by the prescribed delay time T1; the gain adjustment circuit 101 adjusts the gain of the output signal of the delay circuit 104; and the amplifier 102 amplifies the output signal of the gain adjustment circuit 101 so as to drive the speaker 103. The speaker 103 emits a sound S1 corresponding to a sound beam having sharp directivity, which is reflected on the wall surface or the sound reflection board 3 so that a reflected sound Sk reaches the listening position U. Thus, the wall surface or the sound reflection board 3 functions as a virtual rear speaker. Strictly speaking, the sound output of the speaker 103 does not form a sound beam; hence, audio elements S1*a*, S1*b*, and S1*c*each having a low sound pressure compared with the sound pressure of a main audio element of the sound S1 are emitted in directions each differing from the emission direction of the sound S1. Within these audio elements, the audio element S1*a* emitted towards the listening position U directly is dampened using the sound S2 emitted from the directional speaker 2.

The inversion circuit 201 of the directional speaker 2 inverts the polarity of the surround-channel audio signal in order to realize an inverse phase for the audio signal in the directional speaker 1. The output signal of the inversion circuit 201 is supplied to the amplifier 204, in which it is amplified, via the delay circuit 202 and the gain adjustment circuit 203. The speaker 205 is driven by the output signal of the amplifier 204, thus emitting the sound S2. The delay time of the delay circuit 202 and the gain of the gain adjustment circuit 203 are adjusted in advance such that the audio element S1*a* reaching the listening position from the directional speaker 1 directly is canceled out by the sound S2 emitted directly to the listening position U from the directional speaker 2.

The audio element S1*a* emitted from the speaker 103 of the directional speaker 1 reaches the listening position U with a delay time LNA/V, wherein LNA represents a distance from the speaker 103 to the listening position U, and V represents the speed of sound. Similarly, the sound S2 emitted from the speaker 205 of the directional speaker 2 reaches the listening position with a delay time LNB/V, wherein LNB represents a distance from the speaker 205 to the listening position U. Hence, there is a time difference (LNA−LNB)/V between an arrival time of the audio element S1*a*from the speaker 103 at the listening position U and an arrival time of the sound S2 from the speaker 205 at the listening position U. That is, an audio signal whose phase is inverted in the directional speaker 2 is delayed by (LNA−LNB)/NV+T1, so that the audio element S1*a* and the sound S2 have mutually inverted phases at the listening position U; as a result, it is possible to dampen the audio element S1*a*. As described above, the delay time of the delay circuit 202 is adjusted in advance to compensate for the difference between the distances LNA and LNB such that the sound S2 emitted from the directional speaker 2 comes to have a desired phase at the listening position U.

The aforementioned description is given with attention given to phases only. It is possible to calculate sound pressure of the audio element S1*a* at the listening position U based on the directivity of the directional speaker 1 and the distance LNA. Similarly, it is possible to calculate sound pressure of the sound S2 at the listening position U. By adjusting the gain of the gain adjustment circuit 203 based on calculation results, it is possible to control a dampening value for the audio element S1*a*; hence, it is possible to control the audio element S1*a* to make it have a desired sound pressure at the listening position U.

As described above, the present embodiment can dampen the audio element S1*a* reaching the listener from the directional speaker 1 directly by use of the sound S2 emitted from the directional speaker 2. That is, it is possible to relatively enhance the sound Sk, which reaches the listener after being reflected on the wall surface or the sound reflection board 3, compared with the audio element S1*a* reaching the listener from the directional speaker 1 directly. Thus, it is possible to realize sound localization similar to that realized by arranging rear speakers in the rear of the listener.

Second Embodiment

Figure 3:
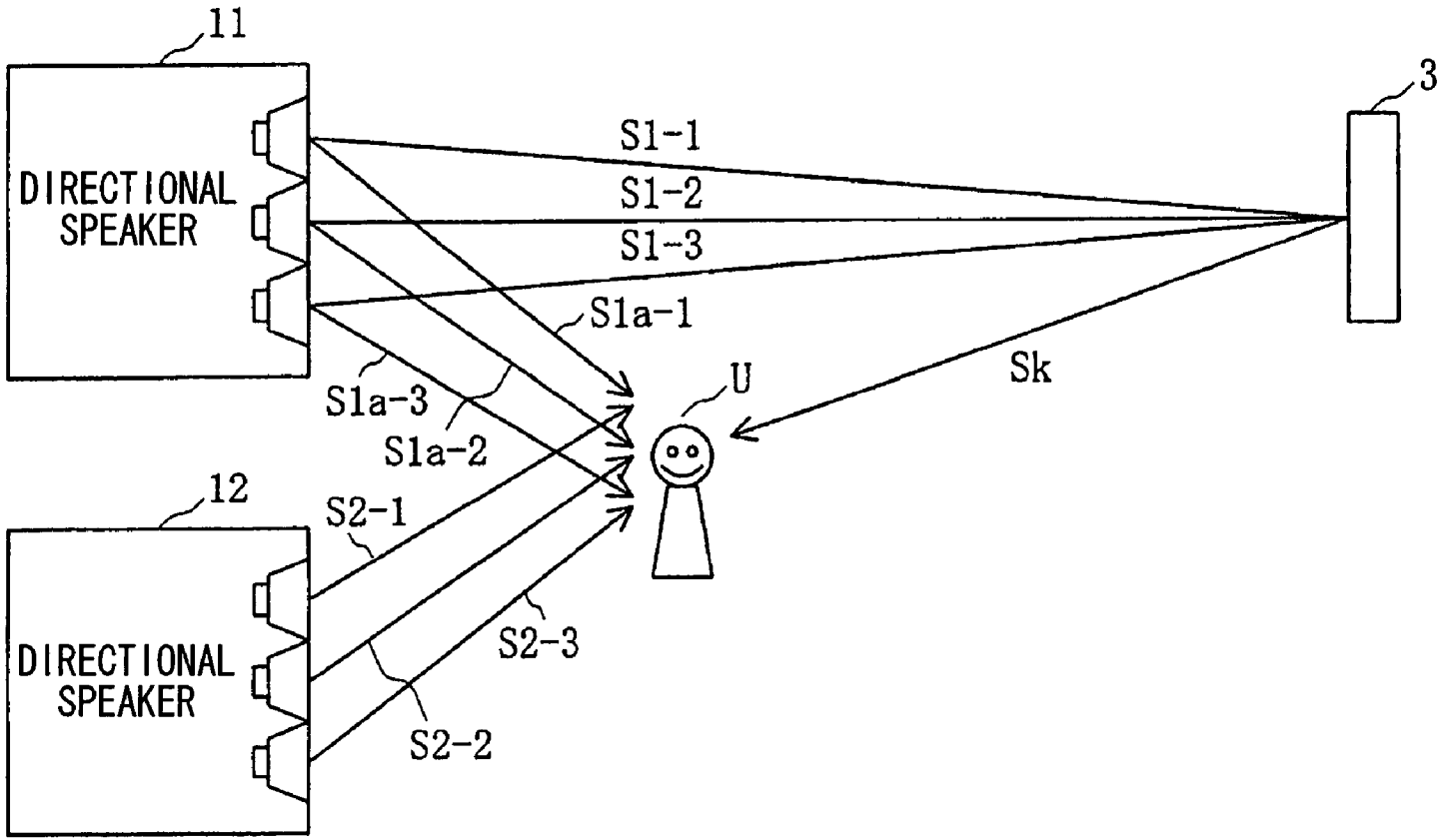
FIG. 3 is a block diagram showing the constitution of a directional speaker control system in accordance with a second embodiment of this invention.
Figure 4:
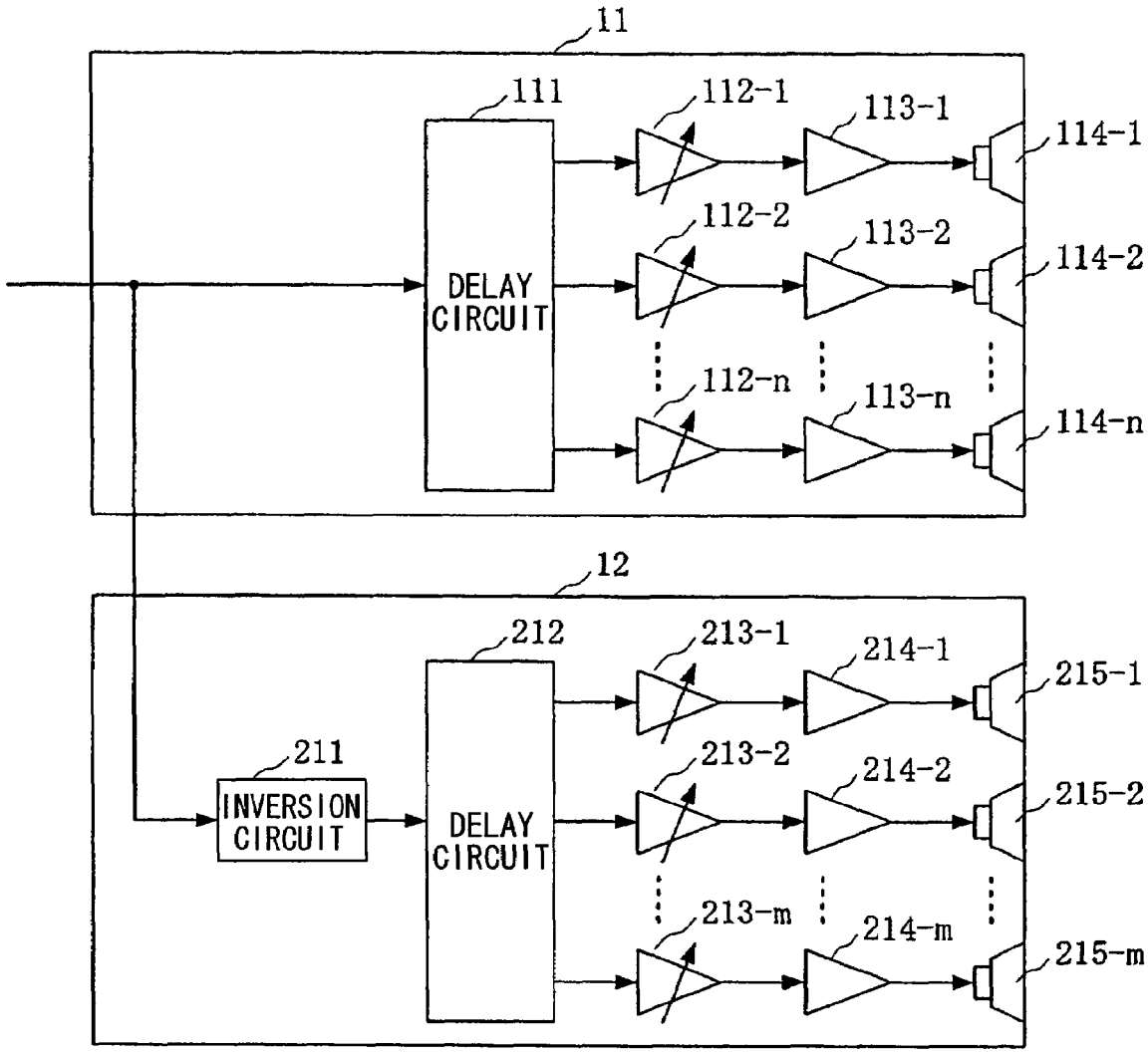
FIG. 4 is a block diagram showing internal constitutions of first and second directional speakers in the second embodiment.

Next, a second embodiment of this invention will be described. FIG. 3 is a block diagram showing the constitution of a directional speaker control system of the second embodiment. The second embodiment is characterized in that array speakers are used for a first directional speaker 11 and a second directional speaker 12 respectively. FIG. 4 is a block diagram showing internal constitutions of the directional speakers 11 and 12.

The first directional speaker 11 includes a delay circuit 111 for applying a delay time, corresponding to the directivity (i.e., a focal position of a sound beam) to be realized, to an input surround-channel audio signal, plural gain adjustment circuits 112 (112-1 to 112-*n*) for adjusting gains of output signals of the delay circuit 111 to desired gains, plural amplifiers 113 (113-1 to 113-*n*) for amplifying output signals of the gain adjustment circuits 112, and plural speakers 114 (114-1 to 114-*n*) driven by the amplifiers 113.

The second directional speaker 12 includes an inversion circuit 211 for inverting the phase of the surround-channel audio signal, a delay circuit 212 for applying a delay time to an output signal of the inversion circuit 211 so as to realize directivity in which the second sound S2 is emitted from the directional speaker 12 towards the listening position U and so as to cancel out the audio element S1*a* of the first sound, emitted directly to the listening position U from the first directional speaker 11, by use of the second sound S2, plural gain adjustment circuits 213 (213-1 to 213-m) for adjusting gains of output signals of the delay circuit 212 so that the audio element S1*a* is canceled out by the second sound S2, plural amplifiers 214 (214-1 to 214-m) for amplifying output signals of the gain adjustment circuits 213, and plural speakers 215 (215-1 to 215-m) driven by the amplifiers 214. In the above, the first directional speaker 11 arrays the plural speakers 114 whose number is n (where n is an integer that is two or higher) in a two-dimensional manner, and the second directional speaker 12 arrays the plural speakers 215 whose number is m (where m is an integer that is two or higher) in a two-dimensional manner, and n=m or n≠m.

Figure 5:
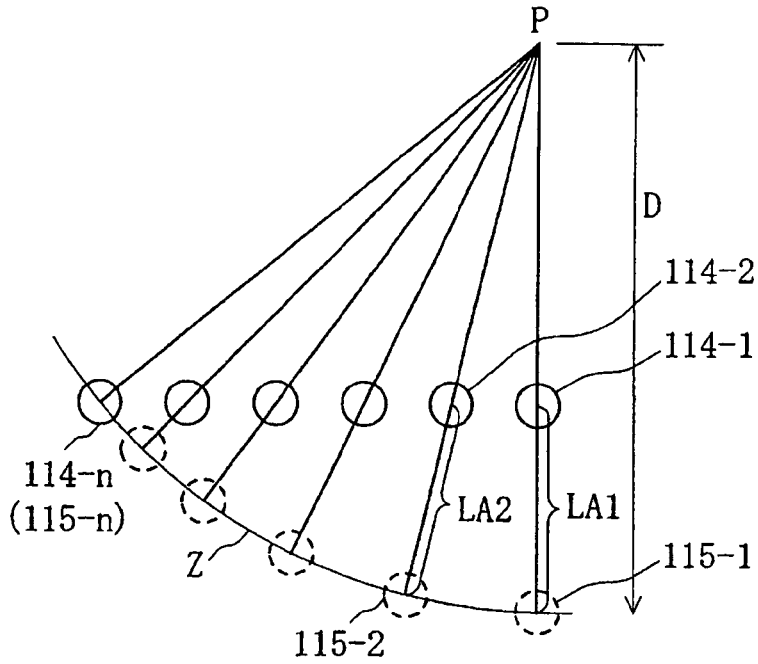
FIG. 5 is a drawing for explaining a directivity control method for the directional speaker of the second embodiment.

Next, the operation of the directional speaker control system of the second embodiment will be described in detail. The first directional speaker 11 performs directivity control such that sounds emitted from the speakers 114 are directed towards a prescribed wall surface or a sound reflection board 3. The directivity control of the first directional speaker 11 will be described with reference to FIG. 5. Herein, reference symbol Z designates an circular arc that is separated from a position P on the wall surface or the sound reflection board 3 by a distance D; and virtual speakers 115 (115-1 to 115-*n*) denoted by dotted circles are arranged at intersection points at which line segments connecting the position P and the speakers 114 (114-1 to 114-*n*) of the first directional speaker 11 are extended to intersect with the circular arc Z. Since the same distance D lies between the position P and the virtual speakers 115, sounds emitted from the virtual speakers 115 reach the position P at the same time.

In order to make all the sounds emitted from the speakers 114-*i* (where i=1, 2, . . . , n) of the first directional speaker 11 reach the position P at the same time, it is required that a delay time LAi/V corresponding to a distance LAi between each speaker 114-*i* and its corresponding virtual speaker 115-*i* be applied to an input signal of the speaker 114-*i*. Based on the aforementioned operation principle of an array speaker, the delay circuit 111 of the first directional speaker 11 applies the delay time LAi/V corresponding to each speaker 114-*i* to an input surround-channel audio signal, thus outputting n delayed audio signals.

The gain adjustment circuits 112-*i* adjust gains of output signals of the delay circuit 111; and the amplifiers 113-*i* amplify output signals of the gain adjustment circuits 112-*i* so as to drive the speakers 114-*i*.

As described above, by adjusting the delay time applied to an audio signal per each speaker 114-*i*, the sound emitted from the first directional speaker 11 can be controlled in directivity; hence, it is possible to make the sounds emitted from the speakers 114-*i* have the same phase at a single point (i.e., a focal point) in space. The first sound S1 emitted from the directional speaker 11 is reflected on the wall surface or the sound reflection board 3, so that the reflected sound Sk reaches the listening position U.

Figure 6:
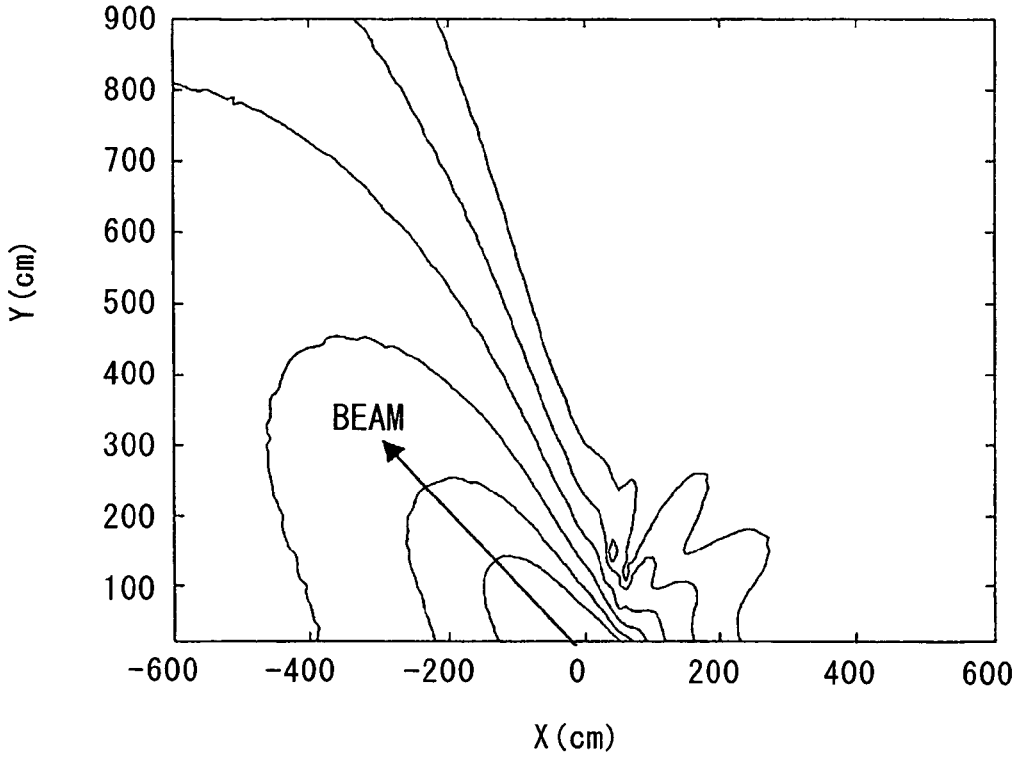
FIG. 6 is a graph of sound pressure distribution showing the directivity of the first directional speaker of the second embodiment.

FIG. 6 is a graph of sound pressure distribution showing an example of directivity realized by the first directional speaker 11. FIG. 6 shows contour lines of sound pressure levels measured upon generation of a single-frequency sound (e.g., 1 kHz) with respect to an X-Y plane, and it shows variations of sound pressure levels when plural speakers 114 are arrayed at 0 cm on the X-axis. By using an array speaker for the first directional speaker 11, it is possible to realize intense directivity (i.e., sound beam) in a direction of the arrow in FIG. 6. As described for the first embodiment, this shows that certain sound pressures occur in directions other than the direction of the sound beam.

The present embodiment dampens the audio element S1*a* (S1*a*-1 to S1*a*-*n*), which is directly emitted towards a listener within audio elements dispersed in directions differing from the direction of the sound beam, by use of the sound S2 (S2-1 to S2-*n*) emitted from the second directional speaker 12.

As in the first embodiment, the inversion circuit 211 of the second directional speaker 12 inverts the phase of the aforementioned surround-channel audio signal.

The delay time of the delay circuit 212 is adjusted in advance such that the sound S2 emitted from the second directional speaker 12 is directed towards the listening position U, and the audio element S1*a* emitted directly to the listening position U from the first directional speaker 11 is canceled out by the sound S2.

In order to simplify calculations, both the directional speakers 11 and 12 include the same number of speakers (where n=m), wherein an audio element S1*a*-*i* emitted to the listening position U from one speaker 114-*i* of the first directional speaker 11 is dampened by use of an audio element S2-*i* emitted from one speaker 215-*i* of the second directional speaker 12. For the sake of convenience, the present embodiment is not designed to perform precise directivity control in the second directional speaker 12.

With regard to a distance LNAi from the speaker 114-*i* of the first directional speaker 11 to the listening position U and a distance LNBi from the speaker 215-*i* of the second directional speaker 12 to the listening position U, in order to compensate for a difference between these distances, as in the first embodiment, it is necessary to apply a delay time (LNAi−LNBi)/V to an input signal of the speaker 215-*i*. Since the delay circuit 111 applies a delay time LAi/V to the sound output from the speaker 114-*i*, it is necessary to apply the delay time LAi/V to the sound output from the speaker 215-*i*.

Therefore, the delay circuit 212 of the second directional speaker 12 applies delay times defined by {(LNAi−LNBi)+LAi}/V the output signal of the inversion circuit 211 so as to generate m delay signals.

The gain of the gain adjustment circuit 213-*i* is adjusted in advance such that the audio element S1*a*-*i* directly reaching the listening position U from the speaker 114-*i* is canceled out by the audio element S2-*i* emitted from the speaker 215-*i* toward the listening position U. As described in the first embodiment, it is possible to calculate sound pressures of the audio elements S1*a*-*i* and S2-*i* at the listening position U; hence, based on the calculation results, it is possible to adjust the gain of the gain adjustment circuit 213-*i*.

The amplifier 214-*i* of the second directional speaker 12 amplifies the output signal of the gain adjustment circuit 213-*i* so as to drive the speaker 215-*i*.

As described above, the second embodiment can demonstrate effects similar to those of the first embodiment. In general, sound cancellation using inverse phases may cause feelings of uncomfortableness for listeners. However, when array speakers are used for the directional speakers 11 and 12, they can form sound fields in which sounds of various phases may intermix with each other; hence, even when sound cancellation is performed using inverse phases, there is provided an effect of not making listeners have feelings of uncomfortableness.

Figure 7:
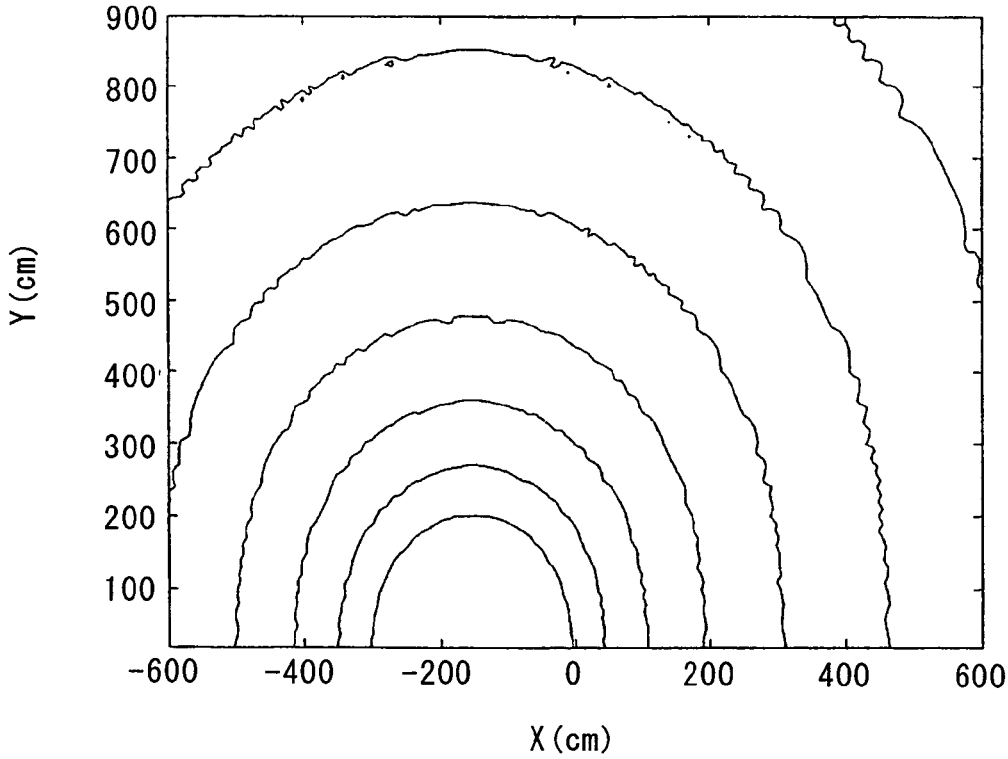
FIG. 7 is a graph of sound pressure distribution showing the directivity of sound emitted in a front direction from the first directional speaker of the second embodiment.
Figure 8:
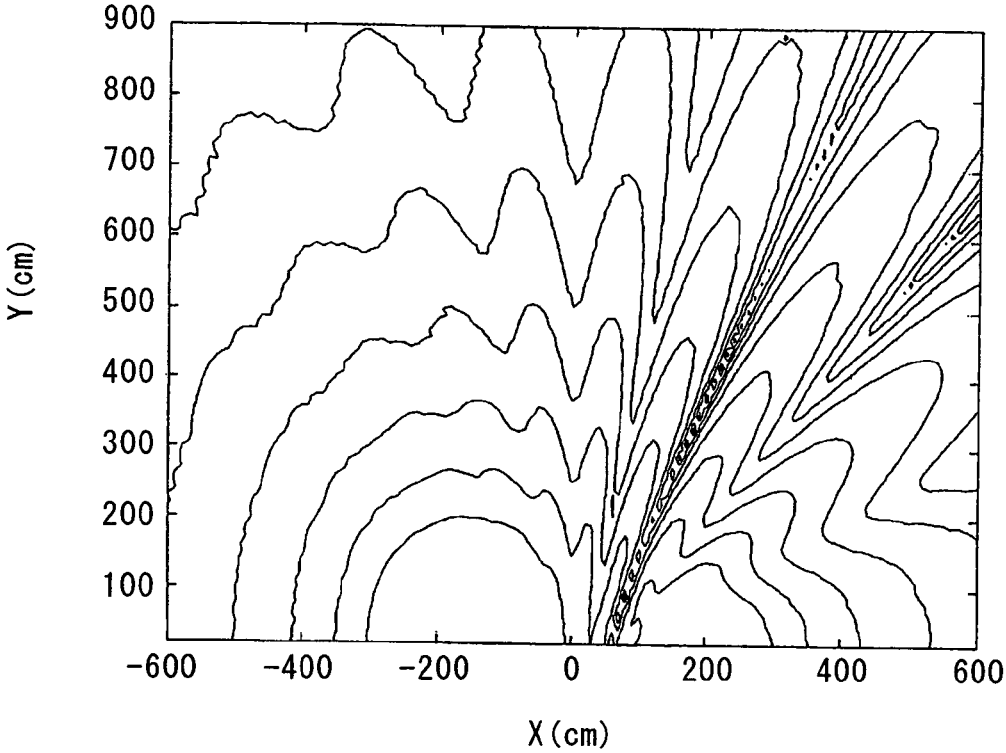
FIG. 8 is a graph of sound pressure distribution realized when the sound emitted from the first directional speaker is dampened using the sound emitted from the second directional speaker in the second embodiment.

FIGS. 7 and 8 show graphs of sound pressure distributions produced upon execution of directivity corrections in accordance with the present embodiment. FIGS. 7 and 8 are graphs each showing contour lines of sound pressure levels measured upon generation of a single-frequency sound (e.g., 500 Hz) with respect to an X-Y plane, wherein a listening position is at 0 cm on the X-axis and 300-400 cm on the Y-axis. Specifically, FIG. 7 shows sound pressure distribution that is measured when the first directional speaker 11 emits a sound in a front direction thereof; and FIG. 8 shows sound pressure distribution that is measured when the sound emitted from the directional speaker 11 is dampened by a sound of an inverse phase emitted from the second directional speaker 12. FIG. 8 shows that sound pressure energy decreases at the listening position.

Third Embodiment

Figure 9:
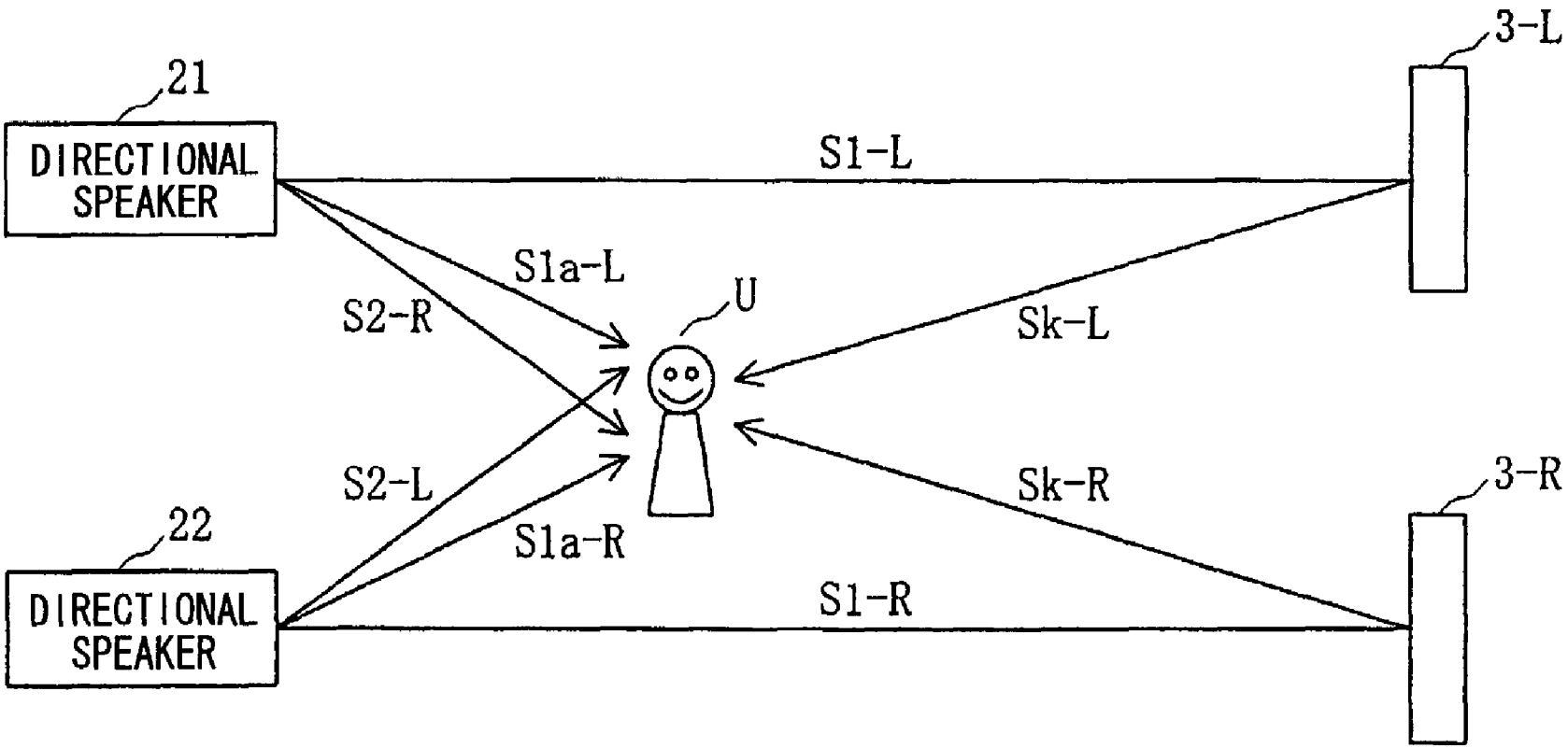
FIG. 9 is a block diagram showing the constitution of a directional speaker control system in accordance with a third embodiment of this invention.

Next, a third embodiment of this invention will be described. The aforementioned first and second embodiments need two directional speakers per channel; hence, four directional speakers in total are needed for a 2-channel surround system. In contrast, the third embodiment provides a practical example in which a 2-channel surround system is actualized using two directional speakers. FIG. 9 is a block diagram showing a directional speaker control system in accordance with the third embodiment, which is constituted using directional speakers 21 and 22. In FIG. 9, reference numeral 3-L designates a wall surface or sound reflection board that serves as an L-channel virtual rear speaker; and reference numeral 3-R designates a wall surface or sound reflection board that serves as an R-channel virtual rear speaker.

The directional speaker 21 functions as a first directional speaker for emitting a sound S1-L toward the wall surface or sound reflection board 3-L based on a rear left signal SL, and it also functions as a second directional speaker for canceling out a sound S1*a*-R reaching a listener directly from the directional speaker 22 by use of a sound S2-R. The directional speaker 22 functions as a first directional speaker for emitting a sound S1-R toward the wall surface or sound reflection board 3-R based on a rear right signal SR, and it also functions as a second directional speaker for canceling out a sound S1*a*-L reaching the listener directly from the directional speaker 21 by use of a sound S2-L.

Figure 10:
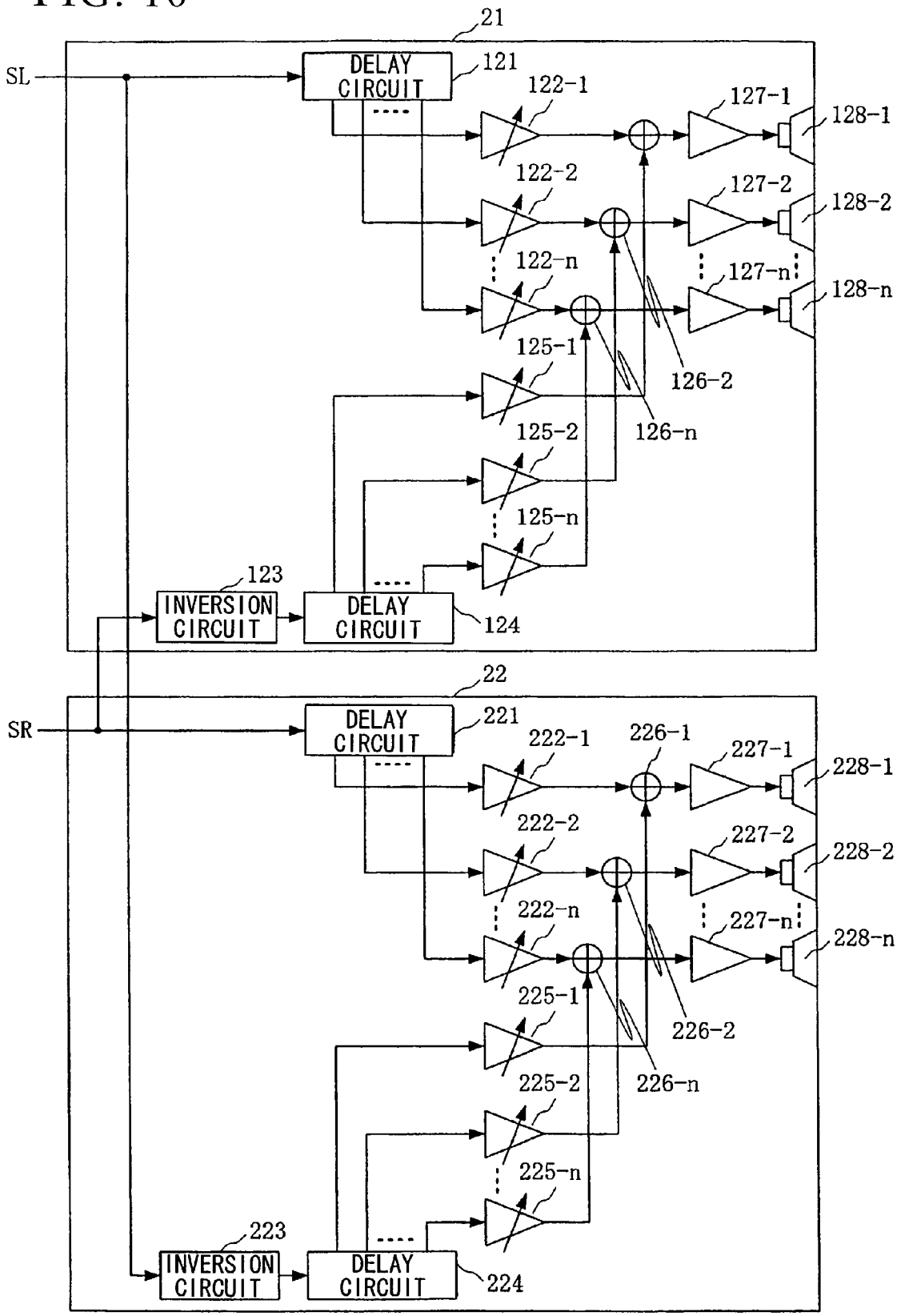
FIG. 10 is a block diagram showing internal constitutions of two directional speakers in the third embodiment.

FIG. 10 is a block diagram showing internal constitutions of the directional speakers 21 and 22. In the present embodiment, the directional speakers 21 and 22 are constituted using array speakers.

The directional speaker 21 includes a delay circuit 121 for applying delay times corresponding to directivities to be realized to an input rear left signal SL, plural gain adjustment circuits 122 (122-1 to **122-*n*) for adjusting gains of output signals of the delay circuit 121 to prescribed values, an inversion circuit 123 for inverting the phase of an input rear right signal SR, a delay circuit 124 for applying delay times to the output signal of the inversion circuit 123 such that the sound S2-R emitted from the directional speaker 21 is directed toward the listening position U, and the sound S1***a*-R emitted directly toward the listening position U from the directional speaker 22 is canceled out by the sound S2-R, plural gain adjustment circuits 125 (125-1 to **125-*n*) for adjusting gains of output signals of the delay circuit 124 such that the sound S1***a*-R is canceled out by the sound S2-R, plural adders 126 (126-1 to **126-*n*) for adding the output signals of the gain adjustment circuits 122 and the output signals of the gain adjustment circuits 125 together, plural amplifiers 127 (127-1 to 127-*n*) for amplifying the output signals of the adders 126, and plural speakers 128 (128-1 to 128-*n*) driven by the outputs of the amplifiers 127**.

The directional speaker 22 includes a delay circuit 221 for applying delay times corresponding to directivities to be realized to an input rear right signal SR, plural gain adjustment circuits 222 (222-1 to **222-*n*) for adjusting gains of output signals of the delay circuit 221 to desired values, an inversion circuit 223 for inverting the phase of an input rear left signal SL, a delay circuit 224 for applying a delay time to the output signal of the inversion circuit 223 such that the sound S2-L emitted from the directional speaker 22 is directed toward the listening position U, and the sound S1***a*-L emitted directly toward the listening position U from the directional speaker 21 is canceled out by the sound S2-L, plural gain adjustment circuits 225 (225-1 to **225-*n*) for adjusting gains of output signals of the delay circuit 224 such that the sound S1***a*-L is canceled out by the sound S2-L, plural adders 226 (226-1 to **226-*n*) for adding the output signals of the gain adjustment circuits 222 and the output signals of the gain adjustment circuits 225 together, plural amplifiers 227 (227-1 to 227-*n*) for amplifying the output signals of the adders 226, and plural speakers 228 (228-1 to 228-*n*) driven by the outputs of the amplifiers 227**.

The operations of the delay circuit 121 and gain adjustment circuits 122 for performing delay and gain adjustment on the rear left signal SL and the operations of the delay circuit 221 and gain adjustment circuits 222 for performing delay and gain adjustment on the rear right signal SR are similar to the aforementioned operations of the delay circuit 111 and gain adjustment circuits 112 used in the second embodiment.

In addition, the operations of the inversion circuit 123, delay circuit 124, and gain adjustment circuits 125 for performing phase inversion and then performing delay and gain adjustment on the rear right signal SR and the operations of the inversion circuit 223, delay circuit 224, and gain adjustment circuits 225 for performing phase inversion and then performing delay and gain adjustment on the rear left signal SL are similar to the aforementioned operations of the inversion circuit 211, delay circuit 212, and gain adjustment circuits 213 used in the second embodiment.

The delay time of the delay circuit 124 applied to the rear right signal SR whose phase is inverted and which is supplied to the speaker **128-*i* (where i=1, 2, . . . , n) is adjusted in advance such that the sound S2-R emitted from the speaker 128-*i* is directed towards the listening position U, and the sound S1***a*-R emitted directly toward the listening position U from the speaker **228-*i* of the directional speaker 22 is canceled out by the sound S2**-R.

Similarly, the delay time of the delay circuit 224 applied to the rear left signal SL whose phase is inverted and which is supplied to the speaker **228-*i* (where i =1, 2, . . . , n) is adjusted in advance such that the sound S2-L emitted from the speaker 228-*i* is directed toward the listening position U, and the sound S1***a*-L emitted directly toward the listening position U from the speaker **128-*i* of the directional speaker 21 is canceled out by the sound S2-L. Incidentally, the adjustment methods for the delay times of the delay circuits 124 and 224** have been described before in conjunction with the second embodiment.

Next, the adder **126-*i* adds the output signal of the gain adjustment circuit 122-*i* (corresponding to the rear left signal SL) and the output signal of the gain adjustment circuit 125-*i* (corresponding to the rear right signal SR whose phase is inverted) together. Similarly, the adder 226-*i* adds the output signal of the gain adjustment circuit 222-*i* (corresponding to the rear right signal SR) and the output signal of the gain adjustment circuit 225-*i*** (corresponding to the rear left signal SL whose phase is inverted) together.

The amplifier **127-*i* amplifies the output signal of the adder 126-*i* so as to drive the speaker 128-*i*. Similarly, the amplifier 227-*i* amplifies the output signal of the adder 226-*i* so as to drive the speaker 228-*i***.

As described above, it is possible to obtain effects similar to those of the second embodiment with respect to the 2-channel surround system. This is because an array speaker can simultaneously emit two or more sounds with different directivities. By use of such an array speaker, it is possible to realize a 2-channel surround system using two directional speakers.

Fourth Embodiment

Figure 11:
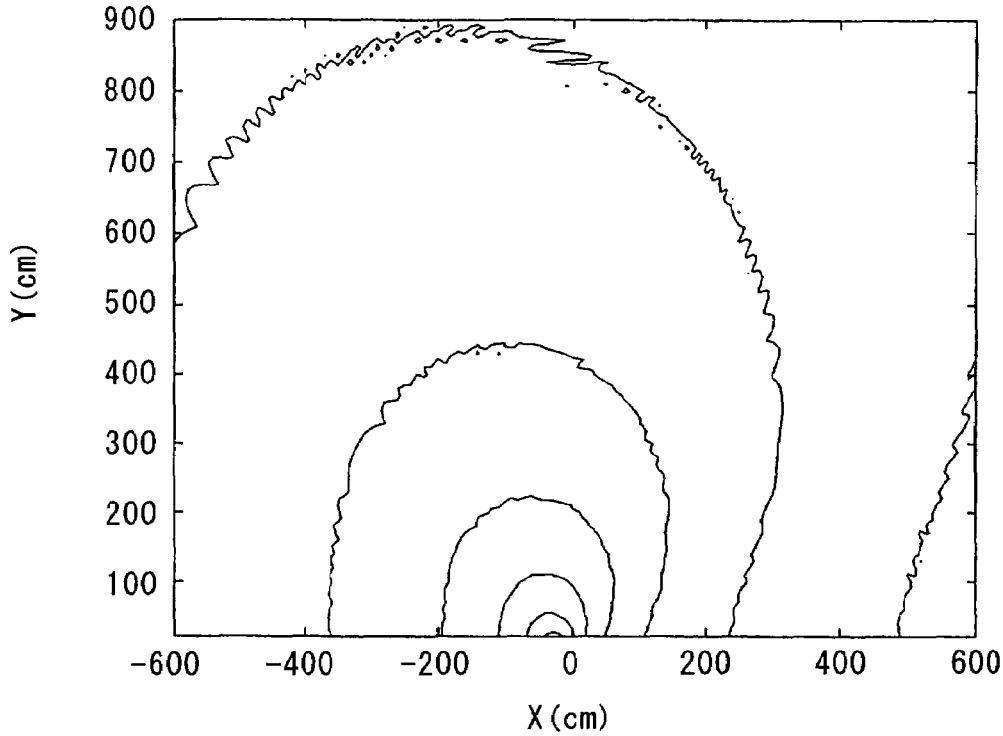
FIG. 11 is a graph of sound pressure distribution showing the directivity of sound emitted in a front direction from a first directional speaker in a fourth embodiment.
Figure 12:
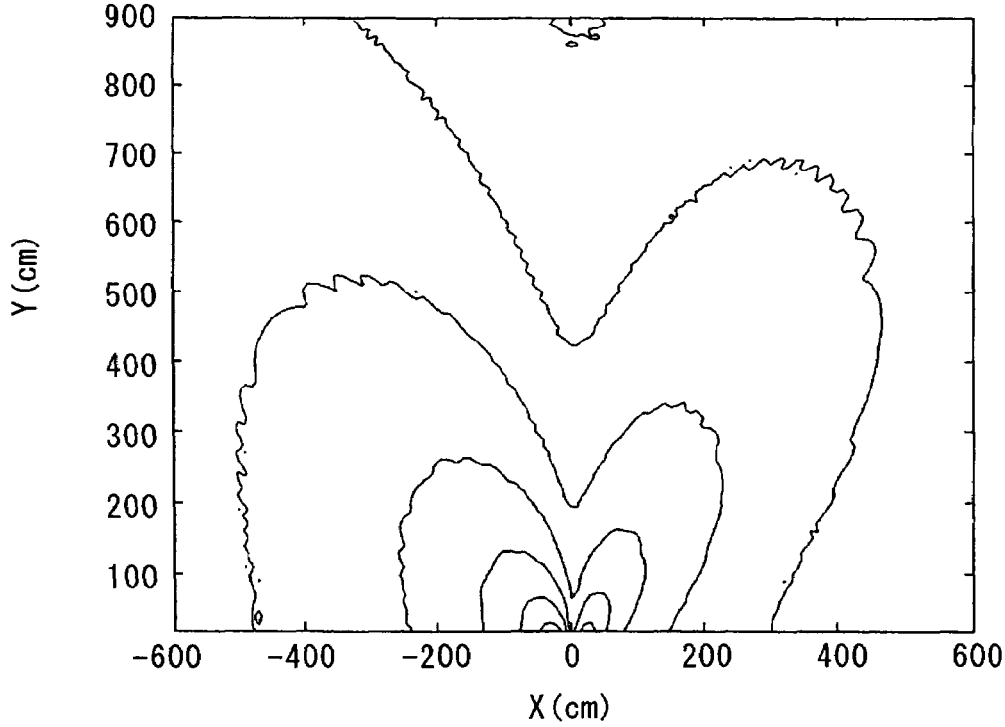
FIG. 12 is a graph of sound pressure distribution realized when the sound emitted from the first directional speaker is dampened using the sound emitted from a second directional speaker in the fourth embodiment.

The directional speaker control system of the third embodiment is constituted using two independent directional speakers 21 and 22. It is possible instead to realize the directional speakers 21 and 22 by dividing a single array speaker. FIGS. 11 and 12 show the results of directivity corrections produced by dividing a single array speaker as described above. FIGS. 11 and 12 show contour lines of sound pressure levels measured upon generation of a single frequency sound (e.g., 500 Hz) with respect to an X-Y plane, wherein a listening position is at 0 cm on the X-axis and 300-400 cm on the Y-axis. Specifically, FIG. 11 shows sound pressure distribution that is produced when the directional speaker 21, which corresponds to a part of an array speaker, emits sound in a front direction thereof. FIG. 12 shows sound pressure distribution that is produced when the sound emitted from the directional speaker 21 is dampened by a sound of an inverse phase emitted from the directional speaker 22, which corresponds to another part of the array speaker. As described above, by dividing a single array speaker, it is possible to arrange the directional speakers 21 and 22 in proximity to each other; hence, it is possible to increase the dampening effect at positions close to 0 cm on the X-axis.

Fifth Embodiment

In the aforementioned first to fourth embodiments performing sound cancellation using inverse phases, a wavelength for a main audio frequency band of 1 kHz maybe set to 30 cm or so, for example; hence, the controllable space should become very small. That is, at the audio frequency of 1 kHz, the phase may be inverted due to shifting of a controlled position by 15 cm. This may cause a phenomenon in which sound to be dampened is instead amplified.

By nature, directional speakers are capable of easily realizing directivity and producing fine sound beams with respect to sounds of higher frequencies, but they have difficulty in narrowing directivity with respect to sounds of lower frequencies, which tend to spread with ease. For this reason, sound beams of higher frequencies emitted from the first directional speaker are not weakened so much and reach the wall surface or sound reflection board, while sounds reaching a listener directly have low energy; hence, it is possible to realize good sound localization in the rear side with respect to higher frequencies. In contrast, low-frequency sound may spread in sound pressure distribution so that no sound beam is produced. This weakens the energy of sound reaching the wall surface or sound reflection board but increases the energy of sound reaching the listener directly. That is, there is a high probability that sound localization in the front side may occur with respect to intermediate-frequency sound and low-frequency sound. Therefore, it is effective to limit the sound subjected to dampening control by the second directional speaker to the low-frequency sound.

Figure 13:
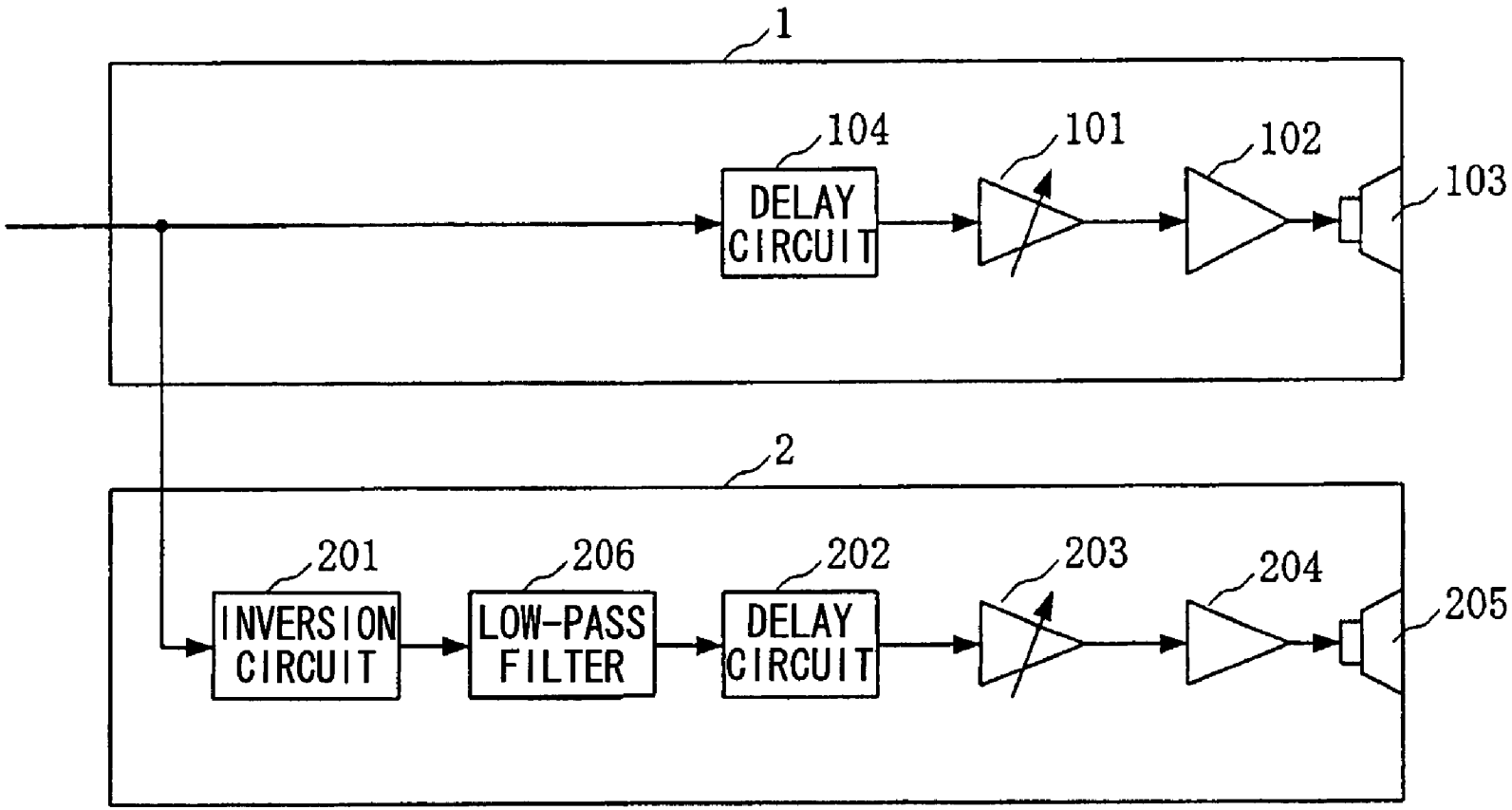
FIG. 13 is a block diagram showing internal constitutions of first and second directional speakers in a directional speaker control system in accordance with a fifth embodiment of this invention.
Figure 14:
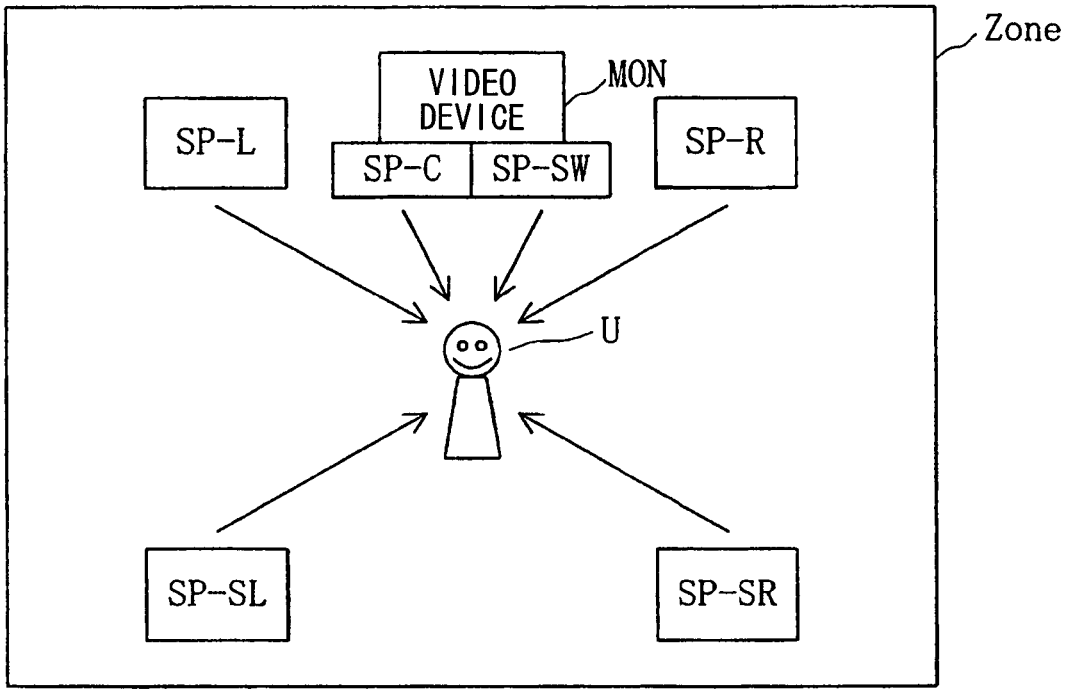
FIG. 14 is a plan view showing an example of a layout of speakers in a digital surround system.
Figure 15:
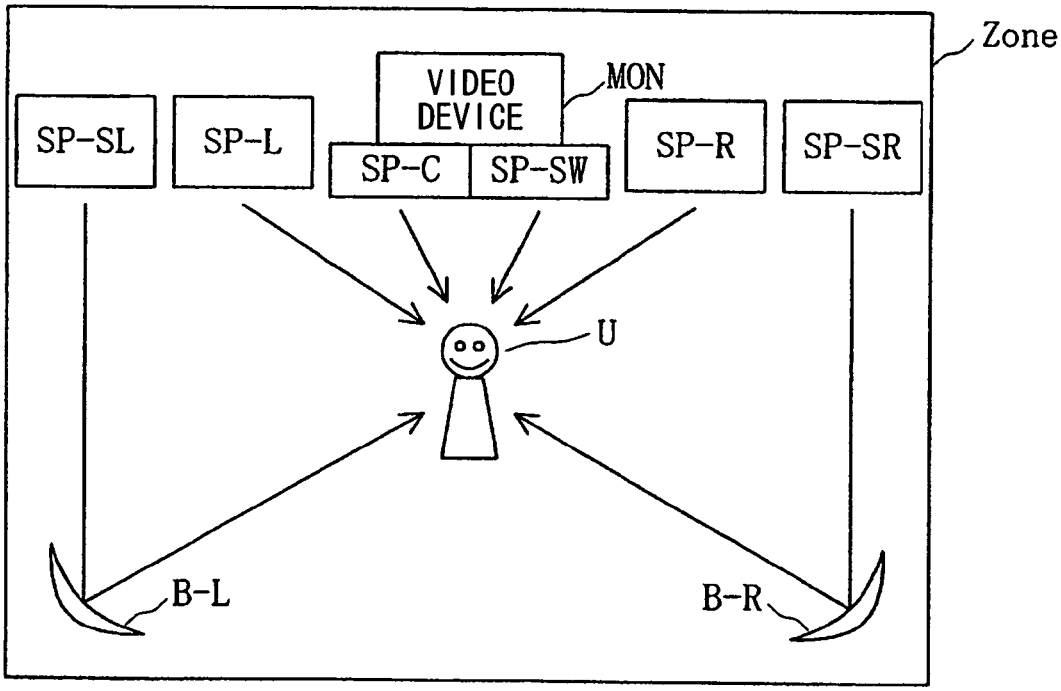
FIG. 15 is a plan view showing an example of a layout of speakers in an audio surround system in which rear speakers are arranged in front of a listening position.
Figure 16:
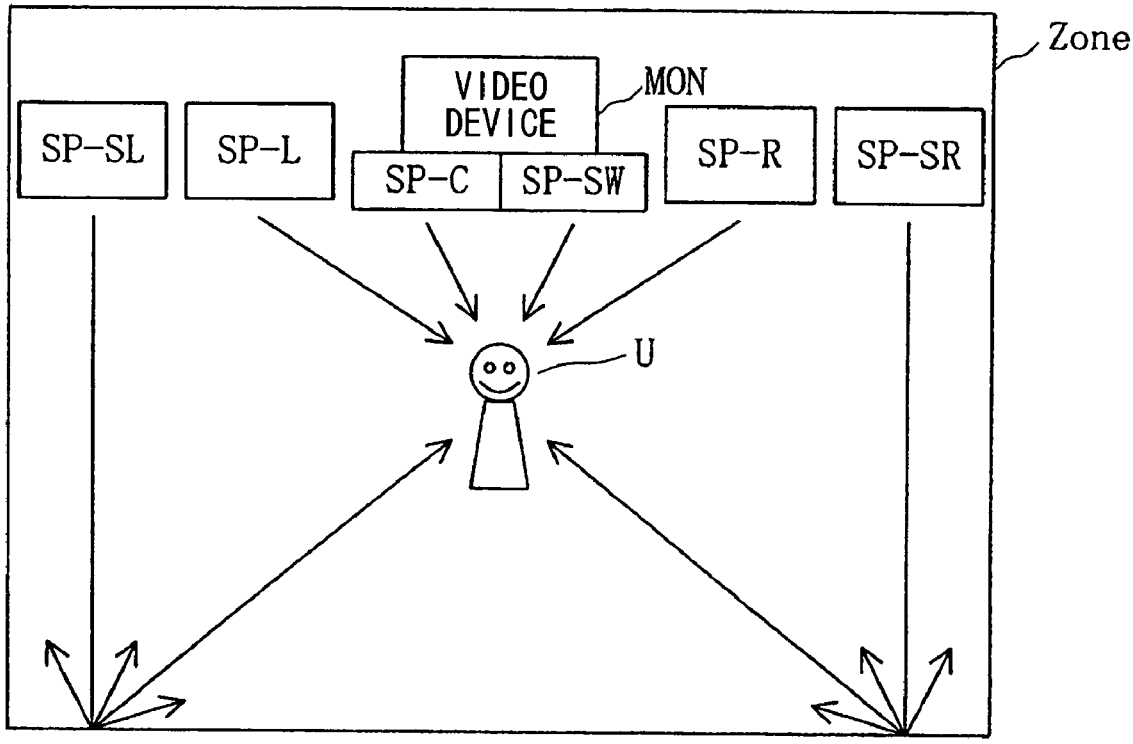
FIG. 16 is a plan view showing an example of a layout of speakers in an audio surround system in which a wall positioned in the rear of a listening position is used as a sound reflection board.

FIG. 13 is a block diagram showing internal constitutions of directional speakers 1 and 2 incorporated in a directional speaker control system in accordance with a fifth embodiment of this invention, wherein parts identical to those shown in FIG. 2 are designated by the same reference numerals. In the fifth embodiment shown in FIG. 13, a low-pass filter 206 for simply filtering low-frequency audio signals whose frequency is several hundreds hertz or less is added to the second directional speaker 2. It is necessary for the low-pass filter 206 not to cause phase rotation; hence, a digital FIR (Finite Impulse Response) filter is used.

Since the sound subjected to dampening control by the second directional speaker 2 is limited to low-frequency sound, the present embodiment can effectively dampen the sound emitted directly toward the listening position from the first directional speaker 1. In addition, it is possible to avoid a problem in which the sound (mainly, the high-frequency sound) to be dampened at the listening position is unintentionally increased.

Incidentally, when the aforementioned constitution of the fifth embodiment is adapted to the second embodiment, it is necessary to additionally provide a low-pass filter at a position preceding the delay circuit 212 (e.g., at a position between the inversion circuit 211 and the delay circuit 212) in the directional speaker 12 shown in FIG. 4. When it is adapted to the third and fourth embodiments, it is necessary to additionally provide a low-pass filter at a position preceding the delay circuit 124 or 224 (e.g., at a position between the inversion circuit 123 or 223 and the delay circuit 124 or 224) in the directional speaker 21 or 22.

As stated heretofore, this invention is not necessarily limited to the aforementioned embodiments; hence, variations and changes within the scope of the invention may be embraced by this invention.

The invention claimed is:

1. A directional speaker control system for producing an audio surround sound, said directional speaker control system comprising:

a first directional array speaker unit having a plurality of first directional speakers arranged in an array each for emitting a first sound toward a wall surface or sound reflection board; and a second directional array speaker unit having a plurality of second directional speakers arranged in an array each for emitting a second sound with an inverse phase directly to a prescribed listening position, without reflecting the second sound from any wall surface or sound reflection board, with respect to an audio element of the first sound directly reaching the prescribed listening position, wherein each of the first and second directional array speaker units further includes a delay circuit for delaying the sound signal, a gain adjustment circuit for each directional speaker for adjusting a gain of an output signal of the delay circuit, and an amplifier for each directional speaker for amplifying an output signal from the gain adjustment circuit and driving the respective directional speaker, wherein the first and second directional array speaker units generate sound fields having various phases intermixed with each other, wherein the second sound from the second directional array speaker unit dampens the audio element of the first sound from the first directional array speaker unit directly reaching the prescribed listening position, wherein the first and second directional array speaker units both receive a same sound signal, wherein the second directional array speaker unit includes an inversion circuit that inverts the sound signal to generate the second sound at the inverse phase, and wherein the delay circuit of the second directional array sneaker unit adjusts the delay applied to the sound signal based on the amount of delay applied to the sound signal in the first directional array speaker unit so that the second sound directly arrives at the prescribed listening position at the same time as the audio element of the first sound directly reaching the prescribed listening position.

2. The directional speaker control system according to claim 1, wherein the first directional array speaker unit and the second directional array speaker unit are composed of a single array speaker unit having a plurality of directional speakers arranged in an array, with the directional speakers divided among the first and second directional array speaker units.

3. The directional speaker control system according to claim 1, wherein the second directional array speaker unit emits only a low-frequency sound as the second sound.

* * * * *